United States Patent [19]

Naka et al.

[11] Patent Number: 5,059,336

[45] Date of Patent: Oct. 22, 1991

[54] GREASE COMPOSITION FOR HIGH SPEED ANTI-FRICTION BEARING

[75] Inventors: Michiharu Naka, Odawara; Hideki Koizumi, Chigasaki; Yukari Kondoh, Fujisawa; Hirotugu Kinoshita, Kawasaki; Mokoto Seikiya, Takarazuka; Masaru Mishima, Kawasaki, all of Japan

[73] Assignees: Nippon Seiko Kabushiki Kaisha; Nippon Oil Co., Ltd., both of Japan

[21] Appl. No.: 568,608

[22] Filed: Aug. 16, 1990

[30] Foreign Application Priority Data

Aug. 22, 1989 [JP] Japan ..... 1-214116

[51] Int. Cl.[5] ..... C10M 141/02

[52] U.S. Cl. ..... 252/33.3; 252/39; 252/40.7; 252/51.5 A; 252/51.5 R

[58] Field of Search ..... 252/33.3, 40.7, 51.5 A, 252/39, 51.5 R

[56] References Cited

U.S. PATENT DOCUMENTS

| | | | |
|---|---|---|---|
| 3,632,509 | 1/1972 | Inami et al. | 252/33.3 |
| 3,846,314 | 11/1974 | Dreher et al. | 252/40.7 |
| 4,201,681 | 5/1980 | Lipinski et al. | 252/33.2 |
| 4,436,649 | 3/1984 | Stemke | 252/51.5 A |
| 4,582,616 | 4/1986 | Kita et al. | 252/40.7 |
| 4,915,860 | 4/1990 | Kinoshita et al. | 252/51.5 A |

*Primary Examiner*—Jacqueline V. Howard

*Attorney, Agent, or Firm*—Majestic, Parsons, Siebert & Hsue

[57] ABSTRACT

A grease composition for a high speed anti-friction bearing contains, in a synthetic lubricant base oil, (A) 2 to 30 wt. % of a thickening agent consisting of an urea comopund, (B) 0.2 to 30 wt. % of sorbitan monooleate, (C) 0.2 to 3.0 wt.% of barium sulfonate, and (D) 0.2 to 3.0 wt. % of barium lanolate, as indispensable components, each weight percentage being based on the total weight of the composition.

17 Claims, No Drawings

GREASE COMPOSITION FOR HIGH SPEED ANTI-FRICTION BEARING

BACKGROUND OF THE INVENTION

This invention relates to a grease composition for a high speed anti-friction or roller bearing and, more particularly, to a grease composition for a high speed roller bearing in which an urea thickener and specific additives are contained in a synthetic lubricant base oil.

Anti-friction bearings are employed in electrical components such as alternators used in motor cars, electromagnetic clutches for car-laden air conditioners, idle pulleys or electrically actuated fan motors, or accessories such as fluid couplings for cooling fans, timing belt tensioners or air pumps. Mainly greases are employed for lubricating the rooler bearings.

Conventionally, as the grease for roller bearings, lithium soap greases employing relatively inexpensive mineral oils as the base oil, polyurea greases or greases, known as wide-range greases, in which the ester synthetic oils are thickened with lithium soap or sodium terephthalamate, are employed. If longer durability than that of the above greases or high temperature durability are required, greases employing silicone oil, fluorosilicone oil or fluorinated oil (perfluoro polyether oil) as the base oil are employed.

In automobiles, in keeping with the propagation of the FF cars aimed at reducing the size and weight of the vehicle, and with the demand for increasing the living space within the cars, the engine room space is necessarily reduced, while the electrical components and accessories with smaller size and weight are required. In addition, higher performance and higher output are demanded of the electrical components and the accessories, such that, in the case of an alternator, for example, it is necessary to increase its rotational speed by designing artifices to compensate for reduction in output caused by reduction in size. Moreover, in keeping with the demand for quiet operation, the degree of hermetic sealing of the engine room and the degree of heating within the engine room are elevated so that components capable of withstanding higher temperatures are necessitated. Presently, a longer service life of the bearings, less grease leakage, superior low temperature properties, superior rust-preventive properties and superior noiseless properties of the bearings are demanded of the greases for use with sealed bearings employed in electrical components and accessories of the motor cars.

Under these conditions, the conventional greases, such as mineral oil - lithium soap grease, mineral oil - polyurea grease or ester synthetic oil - lithium soap bearing under high temperature and high speed conditions, whereas the conventional greases such as the greases employing silicone oil, fluorosilicone oil or fluorinated oil as the base oil, are not fully satisfactory in that they fail to meet such properties as load withstanding properties, wear resistance, rust-preventive properties or noiseless properties, while being extremely expensive.

As a result of researches towards developing the long durability grease for use in high speed anti-friction bearings capable of satisfying the above mentioned properties required of the greases, the greases having synthetic oils as the base oils and urea compounds as the thickener have been found to exhibit various excellent properties as compared to the conventionally employed greases, and are presently attracting attention.

However, the high speed anti-friction bearings present a serious problem in that, since rust-preventive properties are required of the high speed anti-friction bearing, as mentioned hereinabove, rust-preventive agents need to be added to the grease and, should these agents be added in a required amount, the service life of the bearings, which is among the properties intrinsically required of the bearings, is lowered.

SUMMARY OF THE INVENTION

It is a principal object of the present invention to provide a grease composition for a high speed roller bearing which exhibits excellent rust-preventive properties without lowering the service life of the bearing, satisfies the properties demanded of the grease for high speed anti-friction bearings and exhibits various other properties.

The above and other objects of the present invention will become apparent from the following description.

In accordance with the present invention, there is provided a grease composition for a high speed anti-friction bearing containing, in a synthetic lubricant base oil, (A) 2 to 30 wt. % of a thickening agent consisting of an urea compound, (B) 0.2 to 30 wt. % of sorbitan monooleate, (C) 0.2 to 3.0 wt. % of barium sulfonate, and (D) 0.2 to 3.0 wt. % of barium lanolate, as indispensable components, each weight percentage being based on the total weight of the composition.

PREFERRED EMBODIMENTS OF THE INVENTION

The present invention will be explained in detail hereinbelow.

As the synthetic lubricant base oil within the context of the present invention any of the synthetic oils exhibiting the viscosity of the commonly used lubricant oils, may be employed. Specific examples of these oils include poly α-olefins, such as normal paraffin, oligomer, alkylbenzenes such as monoalkyl benzene, dialkylbenzene or polyalkyl benzene, alkyl naphthalenes such as monoalkyl nahthalene, dialkyl naphthalene or polyalkyl naphthalene, diesters such as di-2-ethylhexyl sebacate, dioctyl adipate, diisodecyl adipate, ditridecyl adipate or ditridecyl glutarate, polyol esters such as trimethylol propane caprylate, trimethylol propane pelargonate, pentaerythritol-2-ethyl hexanoate or pentaerythritol pelargonate, polyglycols such as polyethylene glycol, polyethylene glycol monoether, polypropylene glycol, or polypropylene glycol monoether, polyphenyl ethers, tricresyl phosphate, silicone oil or perfluoro alkyl ethers. Above all, poly-α-olefins and/or pentaerythritol esters of fatty acids are preferred. Two or more of the above mentioned oils may be used as an admixture. The preferred viscosity range of the synthetic lubricant base oil is 20 to 300 cSt at 40° C.

As the urea compounds, the component (A) of the present invention, any of the urea compounds known as the thickeners for greases, such as diurea compounds, triurea compounds, tetraurea compounds or polyurea compounds, or mixtures thereof, may be employed. Most preferred is a mixture containing at least two of the diurea compounds represented by the formula $$R_2-NH\overset{O}{\overset{\|}{C}}NH-R_1-NH\overset{O}{\overset{\|}{C}}NH-R_3$$

wherein $R_1$ stands for a divalent aromatic hydrocarbon residue having 6 to 15 carbon atoms, and $R_2$ and $R_3$ may be the same or different and each stands for a cyclohexyl group, a group derived from the cyclohexyl and having 7 to 12 carbon atoms or an alkyl or alkenyl group having 8 to 20 carbon atoms, the relative contents of the cyclohexyl groups and/or the groups derived from the cyclohexyl, represented by [(number of the cyclohexyl groups and/or the groups derived from the cyclohexyl)/(number of the cyclohexyl groups and/or the groups derived from the cyclohexyl plus number of the alkyl groups and/or the alkenyl groups)]×100, ranging within 20 to 90%, preferably from 45 to 75%, and the contents of the diurea compound wherein $R_2$ stands for a cyclohexyl group or a group derived from the cyclohexyl and $R_3$ stands for an alkyl group or an alkenyl group being not less than 10 mol % and preferably 20 to 70 mol %. It is noted that, in the diurea compound represented by the formula (I), the cyclohexyl group, the group derived from the cyclohexyl group, the alkyl group or the alkenyl group exist at any one of the diurea terminals. If the relative contents of the cyclohexyl groups and/or the groups derived from cyclohexyl are less than 20%, the dropping point is markedly lowered and the thickened state is deteriorated, whereas, if the relative contents exceed 90%, the amount of the thickener to be used is increased with obvious economic demerits.

Another preferred urea compound is a compound represented by the formula $$R_5-NH\overset{O}{\overset{\|}{C}}NH-R_4-NH\overset{O}{\overset{\|}{C}}NH-R_6 \qquad (2)$$

wherein $R_4$ stands for a divalent aromatic hydrocarbon residue having 6 to 15 carbon atoms and $R_5$ and $R_6$ may be the same or different and each stands for a cyclohexyl group or a group having 7 to 12 carbon atoms derived from the cyclohexyl, or a mixture of two or more of the compounds (2).

In the above formulas (1) and (2), the divalent aromatic hydrocarbon residues $R_1$ and $R_4$ having 6 to 15 carbon atoms may include, for example, groups represented by the formulas

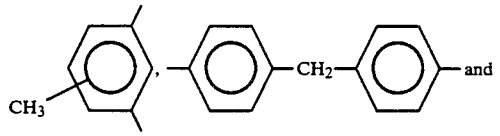

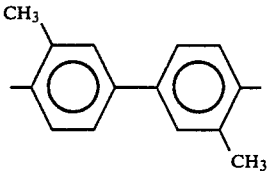

However, any of the divalent aromatic hydrocarbon residues exhibit superior properties, such as thermal stability or stability against oxidation.

The cyclohexyl groups or the C7 to C12 groups derived from the cyclohexyl, that may exist in the above formulas (1) and (2), may include, for example, cyclohexyl, methyl cyclohexyl, dimethyl cyclohexyl, ethyl cyclohexyl, 1-methyl-3-propyl cyclohexyl, butyl cyclohexyl, amyl cyclohexyl, amylmethyl cyclohexyl and hexyl cyclohexyl groups. Most preferred is a cyclohexyl group or a group with 7 or 8 carbon atoms derived from the cyclohexyl, such as, for example, methyl cyclohexyl, dimethyl cyclohexyl and ethyl cyclohexyl groups.

The C8 to C20 alkyl groups or alkenyl groups that may be present in the formula (1) may include, for example, octyl, nonyl, decyl, undecyl, dodecyl, tridecyl, tetradecyl, pentadecyl, hexadecyl, heptadecyl, octadecyl, nonadecyl, eicosyl, octenyl, nonenyl, decenyl, undecenyl, dodecenyl, tridecenyl, tetradecenyl, pentadecenyl, hexadecenyl, heptadecenyl, octadecenyl, nonadecenyl and eicosenyl groups, each having the straight-chained or branched structure. Most preferred are C16 to C19 alkyl or alkenyl groups, such as, for example, hexadecyl, heptadecyl, octadecyl, nonadecyl, hexadecenyl, heptadecenyl, octadecenyl and nonadecenyl groups.

The thickening agent of the component (A) of the present invention composed of the aforementioned urea compounds, may be prepared by any arbitrary methods, and may be prepared by one-step operation by reacting an amine with an isocyanate. Volatile solvents, such as benzene, toluene, xylene, hexane, naphtha, diisobutyl ether, carbon tetrachloride or petroleum ether, may be employed at this time. Lubricant base oils may also be employed as suitable solvents. The reaction temperature of 10 to 200° C. is preferred. In reacting the reaction mass in this manner, the reaction mass need to be mixed and agitated fully to produce a homogeneous grease.

The thickening agent prepared in this manner is freed of solvents, if volatile solvents are employed, and a suitable amount of the aforementioned synthetic lubricant base oil is added thereto to produce a grease. If the synthetic lubricant base oil is used as the solvent, the thickening agent may be employed directly as the grease.

With the grease composition of the present invention, the contents of the component (A), that is the thickening agent, is 2 to 30 wt. % and preferably 3 to 25 wt. %, based on the total weight of the composition. If the contents of the component(A) are less than 2 wt. %, the effects of the thickening agents are nil, whereas, if the contents of the component (A) exceed 30 wt. %, the composition becomes too hard to be used as the grease so that sufficient lubricating properties cannot be produced.

The component (B) of the present invention is sorbitan monooleate represented by the formulas

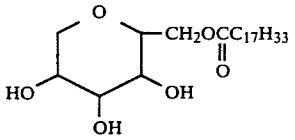

or

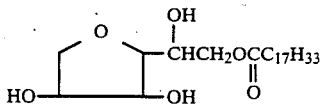

The contents of the component (B) are 0.2 to 3.0 wt. % and preferably 0.5 to 2.0 wt. % based on the total weight of the composition. If the contents of the component (B) are less than 0.2 wt. %, rust-preventive properties are insufficient, whereas, if the contents of the components (B) exceed 3.0 wt. %, the service life of the bearing is shortened.

The component (C) of the present invention is barium sulfonate. As such barium sulfonates, barium salts of sulfonic acids derived from various mineral oils or symthetic sulfonic acids, such as petroleum sulfonic acid, produced at the time of petroleum refining, alkylbenzene sulfonic acid or alkylnaphthalene sulfonic acid. Any of the neutral, basic or perbasic metal sulfonates may be employed.

The contents of the component (C) are 0.2 to 3.0 wt. % and preferably 0.5 to 2.0 wt. % based on the total weight of the composition. If the contents of the component (C) are less than 0.2 wt. %, rust-preventive properties are insufficient, whereas, if the contents of the component (C) exceed 3.0 wt. %, the service life of the bearing is shortened.

The component (D) of the present invention is barium lanolate. This may be obtained by treating commercially available lanolic fatty acid with barium.

The contents of the component (D) are 0.2 to 3.0 wt. % and preferably 0.5 to 2.0 wt. %, based on the total weight of the composition. If the contents of the component (D) are less than 0.2 wt%, rust-preventive properties are insufficient, whereas, if the contents of the component (D) exceed 3.0 wt. %, the service life of the bearing is shortened.

It will be noted that additives further improving the properties of the grease composition of the present invention may be added to the composition without impairing its properties. These additives may include, for example, thickening agents, such as metal soap, bentone or silica gel, extreme pressure agents, such as chlorine-, sulfur-, or phosphorus-containing additives or zinc dithiophosphate agents, oiliness improvers such as fatty acids, animal oil or vegetable oil, viscosity index improvers such as polymethacrylate, polybutene or polystyrene, antioxidants such as amines, phenolic compounds, sulfur compounds or zinc dithiophosphate and metal inactivators, such as benzotriazol or thiadiazol.

In the context of the present invention, the high speed anti-friction bearing means a bearing employing rollers or balls and rotating at a speed of not lower than 500 rpm and preferably not lower than 1000 rpm. The grease composition of the present invention may be employed in a variety of high speed anti-friction bearings including bearings for electrical appliances, such as, for example, bearings for altenators for automotive vehicles, electro-magnetic clutch bearings for car laden air conditioners, idler puley bearings or bearings for motor-driven fan motors, or accessories such as bearings for fluid couplings for cooling fans, bearings for timing belt tensioners or bearings for air pumps.

EXAMPLES OF THE INVENTION

The present invention will be explained in more detail with reference to Synthesis Examples, Examples and Comparative Examples.

SYNTHESIS EXAMPLE 1

46.0 g of diphenylmethane -4, 4'- diisocyanate were charged into 580 g of poly α-olefin oil having a viscosity of 47.6 cSt at 40° C. and the resulting mixture was heated to 60° C. so as to be dissolved uniformly. To this solution was added a solution prepared by dissolving 59.4 g of octadecylamine and 14.6 g of cyclohexylamine in 300 g of the same oil as the aforementioned oil. When the resulting mixture was agitated, a gel-like substance was produced instantaneously. This substance was passed through a roll mill to produce a base grease. The octadecylamino group to cyclohexylamino group ratio of the yielded diurea compound was 60/40, whereas the contents of the thickening agent were 12 wt. %.

SYNTHESIS EXAMPLE 2

72.0 g of bitolylene diisocyanate were charged into 560 g of pentaerythritol ester oil having a viscosity of 33.5 cSt at 40° C. and the resulting mass was heated to 70° C. and dissolved uniformly. To this mixture was added a solution prepared by mixing 30.2g of laurylamine and 37.8 g of cyclohexylamine in 300 g of the same oil as the above mentioned oil under heating for dissolution. When the resulting mixture was agitated, a gel-like substance was produced instantaneously. This substance was passed through a roll mill to produce a base grease. The laurylamino group to cyclohexylamino group ratio of the yielded diurea compound was 29/71, whereas the contents of the thickening agent was 14 wt. %.

SYNTHESIS EXAMPLE 3

60.0 g of tolylene diisocyanate were charged into 500 g of poly α-olefin oil having a viscosity at 40° C. of 51.7 cSt and the resulting mass was heated to 60° C. and mixed uniformly. To this mixture was added a solution of 69.2 g of cyclohexylamine in 320 g of the same oil as the aforementioned oil and, on agitation, a gel-like substance was produced immediately. This substance was passed through a roll mill to yield a base grease. The contents of the thickening agent was 13 wt. %.

EXAMPLES 1 TO 5 AND COMPARATIVE EXAMPLES 1 TO 10

To the base greases produced in accordance with the above Synthesis Examples were added the components (B) to (D) shown in Table 1 to produce the greases shown in Table 1 (Examples 1 to 4). The composition in which the components (B) to (D) were admixed with the commercially available poly α-olefin oil/polyurea greases is also shown in Table 1 (Example 5).

For comparison sake, base greases containing the above mentioned base greases and not containing the components (B) to (D) (Comparative Examples 1 and 2), the greases containing the above mentioned base greases and only one of the components (B) to (D) (Comparative Examples 3 to 5), the greases containing the above mentioned base greases and two of the coponents (B) to (D) (Comparative Examples 6 to 8), and the greases containing mineral oil/diurea grease and poly α-olefin oil/lithium soap grease and also containing the components (B) to (D) (Comparative Examples 9 and 10) are also shown in Table 1.

The following tests for evaluation were conducted on these greases. The results are also shown in Table 1.

TESTS FOR EVALUATING THE PERFORMANCE

1) Consistency

The consistency of the mixture (60W) was measured in accordance with JIS K 2220.

2) Oil Separation

The oil separation was measured at 100° C for 24 hours in accordance with the Tests for Oil Separation prescribed in JIS K 2220 5.7.

3) Dropping Point

The dropping point was measured in accordance with the Testing Method for Dropping Tests prescribed in JIS K 220 5.4.

4) Tests on Rust-Preventive Performance

The rust-preventive performance was tested in accordance with ASTM D 1743. The test results were indicated by the numerals 1, 2 and 3 in the order of the better performance.

5) Tests on Service Life of Bearings 3.4 g of the grease was enclosed in the 6305 vv type bearings and the service life of each of the bearings under test was measured under conditions of 140° C. and 10000 rpm.

TABLE 1

| | Example | | | | | Comparative Example | | |
|---|---|---|---|---|---|---|---|---|
| Number | 1 | 2 | 3 | 4 | 5 | 1 | 2 | 3 |
| Base Oil | | | | | | | | |
| Oil Type | PAO[1] | PAO | PET[2] | PAO | PAO | PAO | PAO | PAO |
| Dynamic Viscosity (40° C.) cSt | 47.6 | 47.6 | 33.5 | 51.7 | — | 47.6 | 51.7 | 47.6 |
| Component A | | | | | | | | |
| Type | Diurea | Diurea | Diurea | Diurea | Polyurea | Diurea | Diurea | Diurea |
| Quantity[3] | 11.8 | 11.1 | 13.7 | 12.4 | 11.0 | 12.0 | 13.0 | 11.8 |
| Amounts of Components[3] | | | | | | | | |
| (B) Sorbitan Monooleate | 0.5 | 2.5 | 0.5 | 1.5 | 1.0 | 0 | 0 | 1.5 |
| (C) Barium Sulfonate | 0.5 | 2.5 | 1.0 | 3.0 | 1.5 | 0 | 0 | 0 |
| (D) Barium Lanolate | 0.5 | 2.5 | 1.0 | 0.5 | 1.5 | 0 | 0 | 0 |
| Viscosity (60 W) | 245 | 261 | 224 | 239 | 270 | 242 | 230 | 245 |
| Oil Separation, %, 100° C., 24 h | 1.9 | 2.1 | 0.5 | 1.0 | 2.0 | 1.5 | 1.0 | 1.4 |
| Dropping Point, °C. | 250+ | 250+ | 250+ | 250+ | 250+ | 250+ | 250+ | 250+ |
| Test on Rust-Preventive Properties | 1 | 1 | 1 | 1 | 1 | 3 | 3 | 3 |
| Service Life of Bearing hr | 4350 | 3950 | 4820 | 4470 | 4310 | 4560 | 5020 | 4210 |

| | Comparative Example | | | | | | |
|---|---|---|---|---|---|---|---|
| Number | 4 | 5 | 6 | 7 | 8 | 9 | 10 |
| Base Oil | | | | | | | |
| Oil Type | PAO | PET | PAO | PAO | PET | Mineral Oil | PAO |
| Dynamic Viscosity (40° C.) cSt | 47.6 | 33.5 | 47.6 | 47.6 | 33.5 | 100 | 47.6 |
| Component A | | | | | | | |
| Type | Diurea | Diurea | Diurea | Diurea | Diurea | Diurea | Lithium |
| Quantity[3] | 11.6 | 13.0 | 11.8 | 11.4 | 13.0 | 12.0 | 10.5 |
| Amounts of Components[3] | | | | | | | |
| (B) Sorbitan Monooleate | 0 | 0 | 1.0 | 0 | 3.0 | 1.0 | 0.5 |
| (C) Barium Sulfonate | 3.0 | 0 | 1.0 | 2.5 | 0 | 1.5 | 0.5 |
| (D) Barium Lanolate | 0 | 7.5 | 0 | 2.5 | 4.0 | 1.5 | 0.5 |
| Viscosity (60 W) | 249 | 227 | 248 | 252 | 231 | 253 | 269 |
| Oil Separation, %, 100° C., 24 h | 0.9 | 0.5 | 2.0 | 1.2 | 0.3 | 1.1 | 3.1 |
| Dropping Point, °C. | 250+ | 250+ | 250+ | 250+ | 250+ | 250+ | 175 |
| Test on Rust-Preventive Properties | 2 | 1 | 3 | 2 | 1 | 1 | 1 |
| Service Life of Bearing hr | 4420 | 2220 | 4230 | 4270 | 2510 | 1890 | 1540 |

[1]Poly-α-olefin
[2]Pentaerythritol
[3]Wt. % based on the total weight of the composition Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A grease composition for a high speed anti-friction bearing comprising, in a synthetic lubricant base oil, (A) 2 to 30 wt. % of a thickening agent consisting of an urea compound, (B) 0.2 to 30 wt. % of sorbitan monooleate, (C) 0.2 to 3.0 wt. % of barium sulfonate, and (D) 0.2 to 3.0 wt. % of barium lanolate, as indispensable components, each weight percentage being based on the total weight of the composition.

2. The composition according to claim 1 wherein said synthetic lubricant base oil is selected from the group consisting of poly α-olefin, a pentaerythritol ester of fatty acids and mixtures thereof.

3. The composition according to claim 2 wherein said poly α-olefin is selected from the group consisting of normal paraffin, isoparaffin, polybutene, polyisobutylene, 1-decene oligomer and mixtures thereof.

4. The composition according to claim 2 wherein said pentaerythritol ester of fatty acid is selected from the group consisting of pentaerythritol-2-ethyl hexanoate, pentaerythritol pelargonate and mixtures thereof.

5. The composition according to claim 1 wherein said synthetic lubricant base oil is selected from the group consisting of monoalkyl benzene, dialkylbenzene, polyalkyl benzene, monoalkyl nahthalene, dialkyl naphthalene, polyalkyl naphthalene, di-2-ethylhexyl sebacate, dioctyl adipate, diisodecyl adipate, ditridecyl adipate, ditridecyl glutarate, trimethylol propane caprylate, trimethylol propane pelargonate, polyethylene glycol, polyethylene glycol monoether, polypropylene glycol, polypropylene glycol monoether, polyphenyl ethers, tricresyl phosphate, silicone oil, perfluoro alkyl ethers and mixtures thereof.

6. The composition according to claim 1 wherein a viscosity range of said synthetic lubricant base oil is 20 to 300 cSt at 40° C.

7. The composition according to claim 1 wherein said urea compound is selected from the group consisting of a diurea compound, a triurea compound, a tetraurea compound, a polyurea compound and mixtures thereof.

8. The composition according to claim 1 wherein said urea compound is a mixture containing at least two of diurea compounds represented by the formula $$R_2-NH\overset{O}{\overset{\|}{C}}NH-R_1-NH\overset{O}{\overset{\|}{C}}NH-R_3$$

wherein $R_1$ stands for a divalent aromatic hydrocarbon residue having 6 to 15 carbon atoms, and $R_2$ and $R_3$ may be the same or different and each stands for a cyclohexyl group, a group derived from the cyclohexyl and having 7 to 12 carbon atoms or an alkyl or alkenyl group having 8 to 20 carbon atoms, relative contents of the cyclohexyl group and/or the group derived from the cyclohexyl, represented by {(number of the cyclohexyl groups and/or the groups derived from the cyclohexyl)/(number of the cyclohexyl group and/or the groups derived from the cyclohexyl plus number of the alkyl groups and/or the alkenyl groups)}×100, ranging within 20 to 90%, and contents of the diurea compound wherein $R_2$ stands for a cyclohexyl group or a group derived from the cyclohexyl and $R_3$ stands for an alkyl group or an alkenyl group being not less than 10 mol %.

9. The composition according to claim 8 wherein the divalent aromatic hydrocarbon residue $R_1$ having 6 to 15 carbon atoms in the above formula (1) is selected from the group consisting of

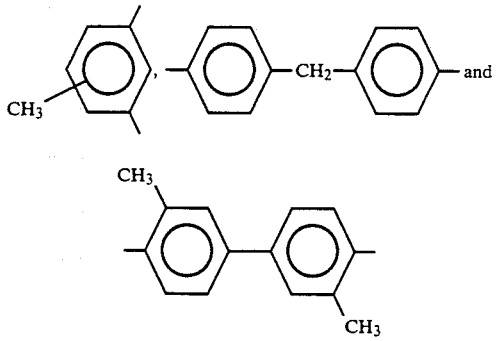

10. The composition according to claim 8 wherein the group derived from the cyclohexyl $R_2$ and $R_3$ having 7 to 12 carbon atoms in the formula (1) is selected from the group consisting of a methylcyclohexyl group, a dimethylcyclohexyl group, an ethylcyclohexyl group, a diethylcyclohexyl group, a propylcyclohexyl group, an isopropylcyclohexyl group, a 1-methyl-3-propylcyclohexyl group, a butylcyclohexyl group, an amylcyclohexyl group, an amylmethylcyclohexyl group and a hexylcyclohexyl group.

11. The composition according to claim 8 wherein the alkyl group $R_2$ and $R_3$ having 8 to 20 carbon atoms in the formula(1) is selected from the group consisting of an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group and an eicosyl group.

12. The composition according to claim 8 wherein the alkenyl group $R_2$ and $R_3$ having 8 to 20 carbon atoms in the formula (1) is selected from the group consisting of an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group and an eicosenyl group.

13. The composition according to claim 1 wherein said urea compound is a compound represented by the formula (2)

$$R_5-NH\overset{O}{\overset{\|}{C}}NH-R_4-NH\overset{O}{\overset{\|}{C}}NH-R_6 \qquad (2)$$

wherein $R_4$ stands for a divalent aromatic hydrocarbon residue with 6 to 15 carbon atoms and $R_5$ and $R_6$ may be the same or different and each stands for a cyclohexyl group or a group having 7 to 12 carbon atoms derived from the cyclohexyl.

14. The composition according to claim 13 wherein the divalent hydrocarbon residue $R_4$ having 6 to 15 carbon atoms in the formula (2) is selected from the group consisting of

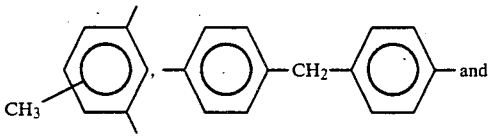

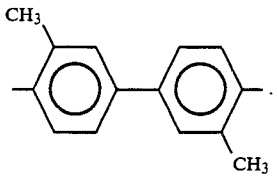

15. The composition according to claim 13 wherein the group derived from the cyclohexyl $R_5$ and $R_6$ having 7 to 12 carbon atoms in the formula (2) is selected from the group consisting of a methylcyclohexyl group, a dimethylcyclohexyl group, an ethylcyclohexyl group, a diethylcyclohexyl group, a propylcyclohexyl group, an isopropylcyclohexyl group, a 1-methyl-3-propylcyclohexyl group, a butylcyclohexyl group, an amylcyclohexyl group, an amylmethylcyclohexyl group and a hexylcyclohexyl group.

16. The composition according to claim 1 wherein the sorbitan monooleate of the component (B) is selected from the group consisting of

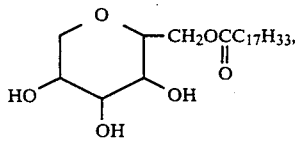

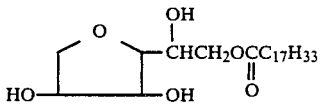

and mixtures thereof.

17. The composition according to claim 1 wherein the barium sulfonate of the component (C) is selected from the group consisting of petroleum barium sulfonate, alkylbenzene barium sulfonate, alkylnaphthalene barium sulfonate and mixtures thereof.

* * * * *